US008105997B2

(12) United States Patent
Zhu et al.

(10) Patent No.: US 8,105,997 B2
(45) Date of Patent: Jan. 31, 2012

(54) COMPOSITION AND APPLICATION OF A TWO-PHASE CONTAMINANT REMOVAL MEDIUM

(75) Inventors: Ji Zhu, El Cerrito, CA (US); Arjun Mendiratta, Berkely, CA (US); David Mui, Fremont, CA (US)

(73) Assignee: Lam Research Corporation, Fremont, CA (US)

( * ) Notice: Subject to any disclaimer, the term of this patent is extended or adjusted under 35 U.S.C. 154(b) by 436 days.

(21) Appl. No.: 12/267,362

(22) Filed: Nov. 7, 2008

(65) Prior Publication Data

US 2010/0116290 A1 May 13, 2010

(51) Int. Cl.
*C11D 3/37* (2006.01)

(52) U.S. Cl. ..... 510/175; 510/176; 134/1.3

(58) Field of Classification Search ..... 510/175, 510/176; 134/1.3
See application file for complete search history.

(56) References Cited

U.S. PATENT DOCUMENTS

2006/0128590 A1 6/2006 Freer et al.
2007/0087950 A1* 4/2007 Korolik et al. ..... 510/175
2007/0155640 A1* 7/2007 Freer et al. ..... 510/175
2009/0156452 A1* 6/2009 Mui et al. ..... 510/175
2010/0317556 A1* 12/2010 Korolik et al. ..... 510/175

* cited by examiner

*Primary Examiner* — Gregory Webb
(74) *Attorney, Agent, or Firm* — Martine Penilla Group LLP

(57) ABSTRACT

The embodiments provide substrate cleaning techniques to remove contaminants from the substrate surface to improve device yield. The substrate cleaning techniques utilize a cleaning material with solid components and polymers with a large molecular weight dispersed in a cleaning liquid to form the cleaning material, which is fluidic. The solid components remove contaminants on the substrate surface by making contact with the contaminants. The polymers with large molecular weight form polymer chains and a polymeric network that capture and entrap solids in the cleaning materials, which prevent solids from falling on the substrate surface. In addition, the polymers can also assist in removing contaminants form the substrate surface by making contacts with contaminants on the substrate surface. In one embodiment, the cleaning material glides around protruding features on the substrate surface without making a forceful impact on the protruding features to damage them. The present invention can be implemented in numerous ways, including a material (or solution), a method, a process, an apparatus, or a system.

16 Claims, 9 Drawing Sheets

COMPOSITION AND APPLICATION OF A TWO-PHASE CONTAMINANT REMOVAL MEDIUM

CROSS REFERENCE TO RELATED APPLICATION

This application is related to U.S. patent application Ser. No. 11/519,354, filed on Sep. 11, 2006, and entitled "Method and System Using a Two-Phases Substrate Cleaning Compound," U.S. patent application Ser. No. 10/347,154, filed on Feb. 2, 2006, and entitled "Cleaning Compound and Method and System for Using the Cleaning Compound," U.S. patent application Ser. No. 12/131,654, filed on Jun. 2, 2008, and entitled "Materials for Particle Removal by Single-Phase and Two-Phase Media," and U.S. patent application Ser. No. 12/165,577, filed on Jun. 30, 2008, and entitled "Single Substrate Processing Head for Particle Removal Using Low Viscosity Fluid." This application is also related to U.S. patent application Ser. No. 12/267,345, filed on the same day as this application, entitled "Composition of a Cleaning Material for Particle Removal." The disclosure of each of these related applications is incorporated herein by reference for all purposes.

BACKGROUND

In the fabrication of semiconductor devices such as integrated circuits, memory cells, and the like, a series of manufacturing operations are performed to define features on semiconductor substrates ("substrates"). During the series of manufacturing operations, the substrate surface is exposed to various types of contaminants. Essentially any material present in a manufacturing operation is a potential source of contamination. For example, sources of contamination may include process gases, chemicals, deposition materials, etch by-products, and liquids, among others. The various contaminants may deposit on the wafer surface in particulate form (or particles).

The surface of semiconductor substrates must be cleaned of substrate contaminants. If not removed, the devices within the vicinity of the contamination will likely be inoperable. Substrate contaminants may also affect device performance characteristics and cause device failure to occur at faster rates than usual. Thus, it is necessary to clean contaminants from the substrate surface in a substantially complete manner without damaging the substrate surface and the features defined on the substrate. The size of particulate contamination is often on the order of the critical dimension size of features fabricated on the wafer. Removal of such small particulate contamination without adversely affecting the surface and features on the substrate can be quite difficult.

In view of the foregoing, there is a need for an improved substrate cleaning technique to remove contaminants from substrate surface to improve device yield.

SUMMARY

Broadly speaking, the embodiments fill the need by providing substrate-cleaning techniques to remove contaminants from the substrate surface to improve device yield. The substrate cleaning techniques utilize a cleaning material with solid components and polymers with a large molecular weight dispersed in a cleaning liquid to form the cleaning material (or cleaning solution, or cleaning compound). The solid components remove contaminants on the substrate surface by making contact with the contaminants. The polymers with large molecular weight form polymer chains and a polymeric network that capture and entrap solids in the cleaning materials, which prevent solids, such as particulate contaminants, impurities, and solid components in the cleaning material, from falling on the substrate surface. In addition, the polymers can also assist in removing contaminants from the substrate surface by making contacts with contaminants on the substrate surface. In one embodiment, the cleaning material glides around protruding features on the substrate surface without making a forceful impact on the protruding features to damage them.

It should be appreciated that the present invention can be implemented in numerous ways, including as a material (or solution), a method, a process, an apparatus, or a system. Several inventive embodiments of the present invention are described below.

In one embodiment, a cleaning material to remove contaminants from a semiconductor substrate surface is provided. The cleaning material includes a cleaning liquid, and a plurality of solid components dispersed in the cleaning liquid. The plurality of solid components interact with at least some of contaminants on the semiconductor substrate surface to remove the contaminants from the substrate surface. The cleaning material also includes polymers of a polymeric compound with a molecular weight greater than 10,000 g/mol. The polymers become soluble in the cleaning liquid and form the cleaning material with the cleaning liquid and the plurality of solid components. The solubilized polymers having long polymer chains capture and entrap solid components and contaminants in the cleaning liquid.

In another embodiment, an apparatus for cleaning contaminants from a substrate surface of a semiconductor substrate is provided. The apparatus includes a substrate support assembly for holding the semiconductor substrate. The apparatus also includes a cleaning material dispense head for applying a cleaning material to clean the contaminants from the substrate surface. The cleaning material contains a cleaning liquid, a plurality of solid components, and polymers of a polymeric compound with a molecular weight greater than 10,000 g/mol. The plurality of solid components and the polymers are dispersed in the cleaning liquid, and wherein the plurality of solid component interact with at least some of contaminants on the semiconductor substrate surface to remove the contaminants from the substrate surface. The polymers become soluble in the cleaning liquid and the solubilized polymers having long polymer chains capture and entrap solid components and contaminants in the cleaning liquid.

In yet another embodiment, a method to remove contaminants from a substrate surface of a semiconductor substrate is provided. The method includes placing the semiconductor substrate in a cleaning apparatus. The method also includes dispensing a cleaning material to clean the contaminants from the substrate surface. The cleaning material contains a cleaning liquid, a plurality of solid components, and polymers of a polymeric compound with a molecular weight greater than 10,000 g/mol. The plurality of solid components and the polymers are dispersed in the cleaning liquid. The plurality of solid components interact with at least some of contaminants on the semiconductor substrate surface to remove the contaminants from the substrate surface. The polymers become soluble in the cleaning liquid and the solubilized polymers having long polymer chains capture and entrap solid components and contaminants in the cleaning liquid.

Other aspects and advantages of the invention will become apparent from the following detailed description, taken in conjunction with the accompanying drawings, illustrating by way of example the principles of the invention.

BRIEF DESCRIPTION OF THE DRAWINGS

The present invention will be readily understood by the following detailed description in conjunction with the accompanying drawings, and like reference numerals designate like structural elements.

DETAILED DESCRIPTION OF THE EXEMPLARY EMBODIMENTS

Several exemplary embodiments for improved substrate cleaning technique to remove particulate contaminants from the substrate to improve process yield are provided. It should be appreciated that the present invention can be implemented in numerous ways, including as a solution, a process, a method, an apparatus, or a system. Several inventive embodiments of the present invention are described below. It will be apparent to those skilled in the art that the present invention may be practiced without some or all of the specific details set forth herein.

The substrate cleaning techniques utilize a cleaning material with solid components and polymers with a large molecular weight dispersed in a cleaning liquid to form the cleaning material (or cleaning solution, or cleaning compound). The solid components remove contaminants on the substrate surface by making contact with the contaminants. The polymers with large molecular weight form polymer chains and a polymeric network that capture and entrap solids in the cleaning materials, which prevent solids, such as particulate contaminants, impurities, and solid components in the cleaning material, from falling on the substrate surface. In addition, the polymers can also assist in removing contaminants from the substrate surface by making contacts with contaminants on the substrate surface. In one embodiment, the cleaning material glides around protruding features on the substrate surface without making a forceful impact on the protruding features to damage them.

Figure 1A:
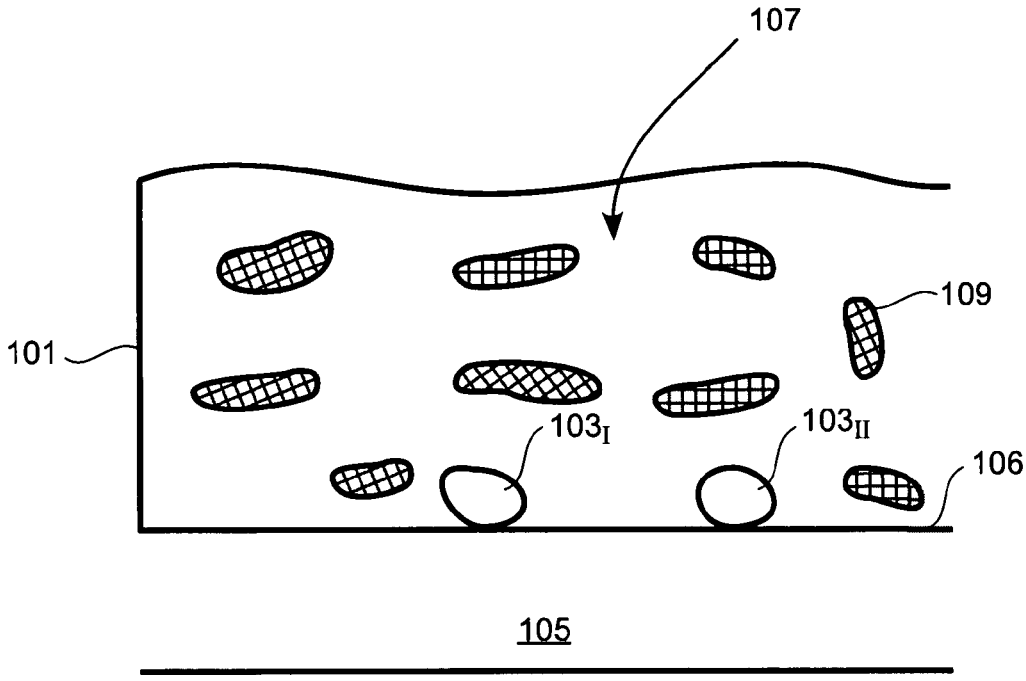
FIG. 1A shows a physical diagram of a cleaning material for removing particulate contamination from a substrate surface, in accordance with one embodiment of the present invention.

FIG. 1A shows a physical diagram of a cleaning material (or solution, or compound) 101 for removing contaminants 103, such as $\mathbf{103}_I$ and $\mathbf{103}_{II}$, from a surface 106 of a semiconductor substrate 105, in accordance with one embodiment of the present invention. The cleaning material (or cleaning solution) 101 includes a cleaning liquid (or solvent) 107, and solid components 109. The solid components 109 are dispersed within the cleaning liquid 107. The cleaning liquid 107 provides a vehicle to bring the solid components 109 proximate to the contaminants 103 in order for the solid components 109 and the contaminants 103, such as $\mathbf{103}_I$ and $\mathbf{103}_{II}$, to interact to eventually remove the contaminants 103 from the substrate surface 106. In one embodiment, the solid components 109 are solubilized by a chemical agent, such as added surfactant. In one embodiment, the cleaning material 101 can be prepared by dissolving a carboxylic acid solid in de-ionized water (DIW) with a weight/weight percent greater than about 0.1%. In one embodiment, the carboxylic acid solid in DIW is less than about less than 20%. Carboxylic acid is characterized by the presence of carboxyl group (—COOH) in the compound. The solid compounds 109 are carboxylic acid solids or salts precipitated from dissolved carboxylic acid in the DIW. In one embodiment, the carbon number of the carboxylic acid is $\geqq 4$. In one embodiment, the carboxylic acid is a fatty acid, which is a carboxylic acid with a long unbranched aliphatic tail (or chain). The mixture of carboxylic acid solids and the surfactant solution (or aqueous solution with surfactant) can be heated to about 75° C. to about 85° C. to shorten the duration for the solids to be dispersed in the surfactant solution. Once the solids are dissolved, the cleaning solution can be cooled down. During the cooling down process, solids in the form of needles or plates of carboxylic acid could precipitate in the cleaning liquid 107.

One thing to note is that the cleaning material (or cleaning solution, or cleaning compound) 101 can be made by mixing the solid components, such as carboxylic acid(s) (or salts), in a liquid other than water. Other types of polar liquids, such as alcohol, can also be used as cleaning liquid 107.

It should be understood that depending on the particular embodiment, the solid components 109 within the cleaning material 101 might possess physical properties representing essentially any sub-state within the solid phase, wherein the solid phase is defined as a phase other than liquid or gas. For example, physical properties such as elasticity and plasticity can vary among different types of solid components 109 within the cleaning material 101. Additionally, it should be understood that in various embodiments the solid components 109 could be defined as crystalline solids or non-crystalline solids. Regardless of their particular physical properties, the solid components 109 within the cleaning material (or cleaning solution, or cleaning compound) 101 should be capable of avoiding adherence to the surface of substrate surface 106 when positioned in either close proximity to or in contact with the substrate surface 106. Additionally, the mechanical properties of the solid components 109 should not cause damage to the substrate surface 106 during the cleaning process. In one embodiment, the hardness of the solid components 109 is less than the hardness of the substrate surface 106.

Figure 1B:
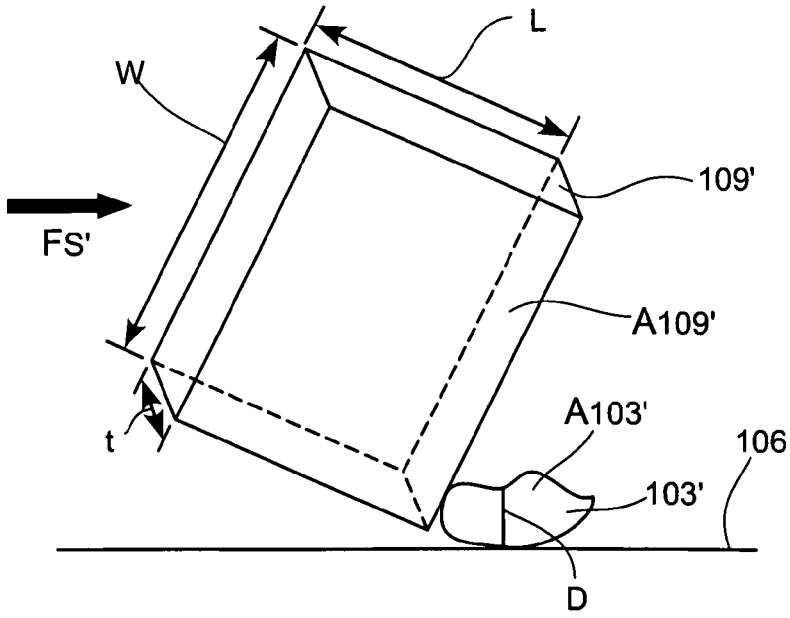
FIG. 1B shows a physical diagram of a solid components of the cleaning solution of FIG. 1A in the proximity of a contaminant on the substrate surface, in accordance with one embodiment of the present invention.

Furthermore, the solid components 109 should be capable of establishing an interaction with the contaminants 103 present on the substrate surface 106 when positioned in either close proximity or contact with the contaminants 103. For example, the size and shape of the solid components 109 should be favorable for establishing the interaction between the solid components 109 and the contaminants 103. In one embodiment, the solid compounds 109 have cross-sectional areas greater than the cross-sectional areas of the contaminants. As shown in FIG. 1B, when a solid compound 109' with a large surface area $A_{109'}$ compared to the surface area $A_{103'}$ of a particulate contaminant 103', the shear force $F_S'$ exerted on the solid compound 109' is transmitted upon the particulate contaminant 103' at a shear force multiplied roughly by the area ratio ($F_S' \times A_{109'}/A_{103'}$). For example, the effective diameter D of the particulate contaminant 103' is less than about 0.1 micron. The width W and length L of the solid compound 109' are both between about 5 micron to about 50 micron and the thickness of the solid compound 109' is between about 1 micron to about 5 micron. The area ratio (or force multiplier) could be between 2,500 to about 250,000 or greater. The shear force exerted on the particulate contaminant 103' could be very large and could dislodge particulate contaminant 103' from the substrate surface 106.

Energy transferred from the solid component 109' to the contaminant 103' can occur through direct or indirect contact and may cause the contaminant 103' to be dislodged from the substrate surface 106. In this embodiment, the solid component 109' may be softer or harder than the contaminant 103'. If the solid component 109' is softer than the contaminant 103', deformation of the solid component 109' is likely to occur during the collision (or contact), resulting in less transfer of kinetic energy for dislodging the contaminant 103' from the substrate surface 106. In this case, the adhesive connection between the solid component 109' and the contaminant 103' may be stronger. If the solid component 109' is harder than the contaminant 103', deformation of the contaminant 103' is likely to occur during the collision, resulting in less transfer of kinetic energy for dislodging the contaminant 103' from the substrate surface 106. If the solid component 109' is at least as hard as the contaminant 103', a substantially complete transfer of energy can occur between the solid component 109' and the contaminant 103', thus increasing the force that serves to dislodge the contaminant 103' from the substrate surface 106. However, in the case where the solid component 109' is at least as hard as the contaminant 103', interaction forces that rely on deformation of the solid component 109' or contaminant 103' may be reduced. It should be appreciated that physical properties and relative velocities associated with the solid component 109' and the contaminant 103' will influence the collision interaction there between.

Figure 1C:
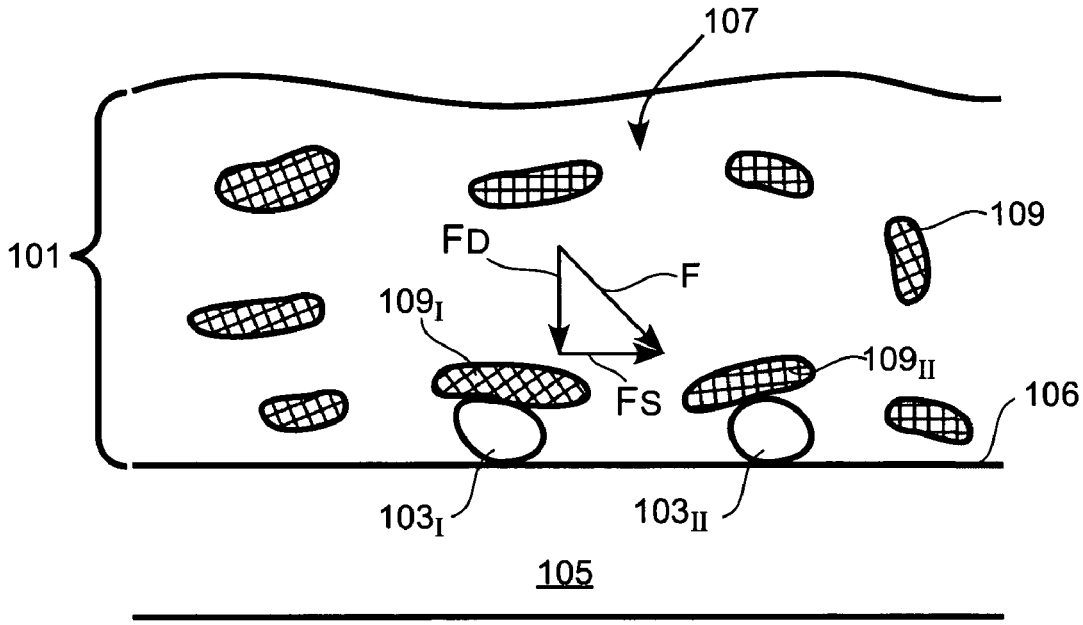
FIG. 1C shows a physical diagram of solid components of the cleaning solution of FIG. 1A making contact with contaminant on the substrate surface, in accordance with one embodiment of the present invention.
Figure 1D:
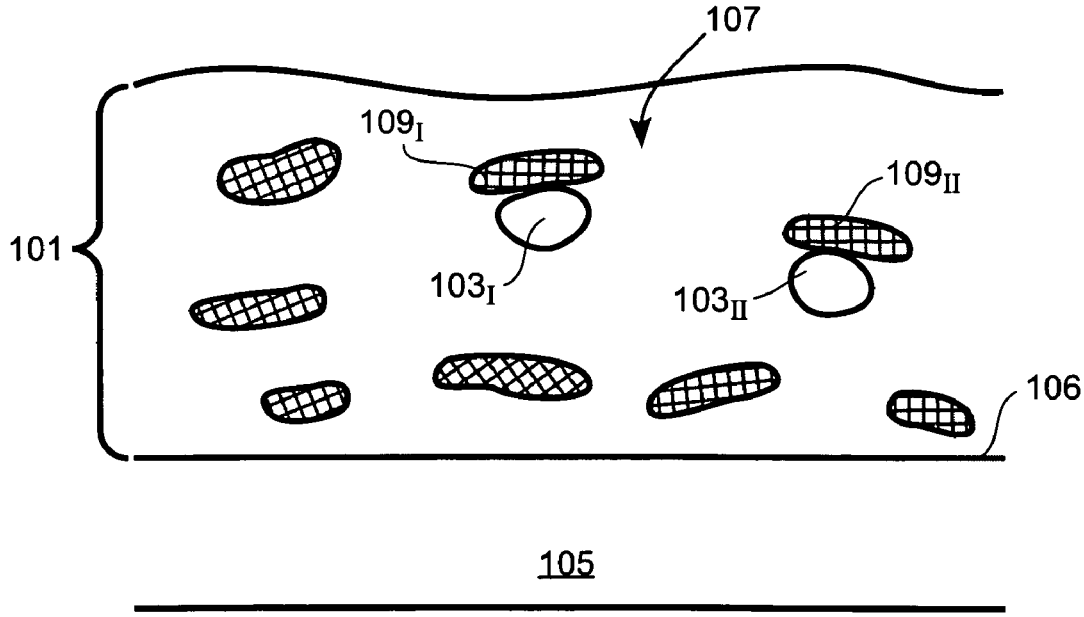
FIG. 1D shows a physical diagram of solid components of the cleaning solution of FIG. 1A moving contaminant away from the substrate surface, in accordance with one embodiment of the present invention.

FIGS. 1C and 1D show an embodiment of how the cleaning material 101 functions to remove the contaminants $\mathbf{103}_I$, $\mathbf{103}_{II}$ from the substrate surface 106. During the cleaning process a downward force $F_D$, which is a downward component of force F, is exerted on the solid component $\mathbf{109}_I$ within the cleaning liquid 107 such that the solid component $\mathbf{109}_I$ is brought within close proximity or contact with the contaminant $\mathbf{103}_I$ on the substrate surface 106. When the solid component $\mathbf{109}_I$ is forced within sufficient proximity to or contact with the contaminant $\mathbf{103}_I$, an interaction is established between the solid component $\mathbf{109}_I$ and the contaminant $\mathbf{103}_I$. The interaction between the solid component $\mathbf{109}_I$ and the contaminant $\mathbf{103}_I$ is sufficient to overcome an adhesive force between the contaminant $\mathbf{103}_I$ and the substrate surface 106, as well as any repulsive forces between the solid component $\mathbf{109}_I$ and the contaminant $\mathbf{103}_I$. Therefore, when the solid component $\mathbf{109}_I$ is moved away from the substrate surface 106 by a sheer force $F_S$, which is a shear component for force F, the contaminant $\mathbf{103}_I$ that interacted with the solid component $\mathbf{109}_I$ is also moved away from the substrate surface 106, i.e., the contaminant $\mathbf{103}_I$ is cleaned from the substrate surface 106. In one embodiment, the interaction between the solid component $\mathbf{109}_I$ and contaminant $\mathbf{103}_I$ occurs when the solid component $\mathbf{109}_I$ is forced sufficiently close to the contaminant $\mathbf{103}_I$. In one embodiment, this distance may be within about 10 nanometers. In another embodiment, the interaction between the solid component $\mathbf{109}_I$ and contaminant $\mathbf{103}_I$ occurs when the solid component $\mathbf{109}_I$ actually contacts the contaminant $\mathbf{103}_I$. This interaction may also be referred to as solid component $\mathbf{109}_I$ engaging contaminant $\mathbf{103}_I$. The interaction between solid component $\mathbf{109}_{II}$ and contaminant $\mathbf{103}_{II}$ is similar to the interaction between solid component $\mathbf{109}_I$ and contaminant $\mathbf{103}_I$.

The interaction forces between the solid component $\mathbf{109}_I$ and the contaminant $\mathbf{103}_I$ and between the solid component $\mathbf{109}_{II}$ and the contaminant $\mathbf{103}_{II}$ are stronger than the forces connecting the contaminants $\mathbf{103}_I$, $\mathbf{103}_{II}$ to the substrate surface 106. FIG. 1D shows when the solid components $\mathbf{109}_I$ and $\mathbf{109}_{II}$ are moved away from the substrate surface 106, the contaminants $\mathbf{103}_I$ and $\mathbf{103}_{II}$ bound to the solid components $\mathbf{109}_I$ and $\mathbf{109}_{II}$ are also moved away from the substrate surface 106. It should be noted that multiple contaminant removal mechanisms could occur during the cleaning process.

It should be appreciated that because the solid components 109 interact with the contaminants 103, such as $\mathbf{103}_I$, $\mathbf{103}_{II}$, to affect the cleaning process. The removal of contaminants, such as $\mathbf{103}_I$ and $\mathbf{103}_{II}$, across the substrate surface 106 will be dependent on how well the solid components 109 are in liquid 107 and are distributed across the substrate surface 106. In a preferred embodiment, the solid components 109 will be so well distributed that essentially every contaminant 103 on the substrate surface 106 will be in proximity to at least one solid component 109. It should also be appreciated that one solid component 109 may come in contact with or interact with more than one contaminant 103, either in a simultaneous manner or in a sequential manner. Furthermore, solid components 109 may be a mixture of different components as opposed to all the same components. Thus, it is possible that the cleaning solution (or material or compound) 101 is designed for a specific purpose, i.e., targeting a specific type contaminants, or the cleaning solution 101 can have a broad spectrum of contaminant targets where multiple types of solid components are provided.

Interaction between the solid components 109 and the contaminants 103 can be established through one or more mechanisms including adhesion, collision, and attractive forces, among others. Adhesion between the solid components 109 and contaminants 103 can be established through chemical interaction and/or physical interaction. For example, in one embodiment, chemical interaction causes a glue-like effect to occur between the solid components 109 and the contaminants 103. In another embodiment, physical interaction between the solid components 109 and the contaminants 103 is facilitated by the mechanical properties of the solid components 109. For example, the solid components 109 can be malleable such that when pressed against the contaminants 103, the contaminants 103 become imprinted within the malleable solid components 109.

In addition to the foregoing, in one embodiment, interaction between a solid component 109 and a contaminant 103 can result from electrostatic attraction. For example, if the solid component 109 and the contaminant 103 have opposite surface charges they will be electrically attracted to each other. It is possible that the electrostatic attraction between the solid component 109 and the contaminant 103 can be sufficient to overcome the force connecting the contaminant 103 to the substrate surface 106.

In another embodiment, an electrostatic repulsion may exist between the solid component 109 and the contaminant 103. For example, both the solid component 109 and the contaminant 103 can have either a negative surface charge or a positive surface charge. However, if the solid component 109 and the contaminant 103 can be brought into close enough proximity, the electrostatic repulsion there between can be overcome through van der Waals attraction. The force applied through the liquid 107 to the solid component 109 may be sufficient to overcome the electrostatic repulsion such that van der Waals attractive forces are established between the solid component 109 and the contaminant 103.

Additionally, in another embodiment, the pH (potential of hydrogen) of the cleaning liquid 107 can be adjusted to compensate for surface charges present on one or both of the solid component 109 and contaminant 103, such that the electrostatic repulsion there between is reduced to facilitate interaction, or so that either the solid component or the contamination exhibit surface charge reversal relative to the other resulting in electrostatic attraction. For example, a base, such as Ammonium Hydroxide ($NH_4OH$), can be added to a cleaning solution with solid components of a carboxylic acid (a fatty acid), for example made by dissolving 2-4% of a carboxylic acid in DIW, to increase the pH value of the cleaning solution. The amount of $NH_4OH$ added is between about 0.05% to about 5%, preferably between about 0.25% to about 2%. Ammonium Hydroxide helps the carboxylic acid (or fatty acid) solids become salt form, which is easier to be dispersed in the cleaning solution. Ammonium Hydroxide can also hydrolyze the contaminants 103. To clean metal contaminants, lower pH solution can also be used. Acidic solution can be used to tune the pH value to be between about 2 to about 9.

In addition to using a base, such as Ammonium Hydroxide, to enhance cleaning efficiency, a surfactant, such as ammonium dodecyl sulfate, $CH_3(CH_2)_{11}OSO_3NH_4$, can also be added to the cleaning material. In one embodiment, about 0.1% to about 5% of surfactant is added to the cleaning solution 101. In a preferred embodiment, about 0.5% to about 2% surfactant is added to the cleaning solution 101.

In addition, the solid components 109 should avoid dissolution or have limited solubility in the cleaning liquid 107, and should have surface functionality that enables dispersion throughout the cleaning liquid 107. For solid components 109 that do not have or have limited surface functionality that enables dispersion throughout the liquid medium 107, chemical dispersants may be added to the liquid medium 107 to enable dispersion of the solid components 109 throughout the cleaning liquid 107. Depending on their specific chemical characteristics and their interaction with the surrounding cleaning liquid 107, solid components 109 may take one or more of several different forms. For example, in various embodiments the solid components 109 may form aggregates, colloids, gels, coalesced spheres, or essentially any other type of agglutination, coagulation, flocculation, agglomeration, or coalescence. In other embodiments, the solid components 109 may take a form not specifically identified herein. Therefore, the point to understand is that the solid components 109 can be defined as essentially any solid material capable of functioning in the manner previously described with respect to their interaction with the substrate surface 106 and the contaminants 103.

Some exemplary solid components 109 include aliphatic acids, carboxylic acids, paraffin, cellulose, wax, polymers, polystyrene, polypeptides, and other visco-elastic materials. The material of solid components 109 should be present at a concentration that exceeds its solubility limit within the cleaning liquid 107. In addition, it should be understood that the cleaning effectiveness associated with a particular material for solid components 109 might vary as a function of temperature, pH, and other environmental conditions.

The aliphatic acids represent essentially any acid defined by organic compounds in which carbon atoms form open chains. A fatty acid is an example of an aliphatic acid and an example of a carboxylic acid that can be used as the solid components 109 within the cleaning material 101. Examples of fatty acids that may be used as the solid components 109 include lauric, palmitic, stearic, oleic, linoleic, linolenic, arachidonic, gadoleic, eurcic, butyric, caproic, caprylic, myristic, margaric, behenic, lignoseric, myristoleic, palmitoleic, nervanic, parinaric, timnodonic, brassic, clupanodonic acid, lignoceric acid, cerotic acid, and mixtures thereof, among others. In one embodiment, the solid components 109 can represent a mixture of fatty acids defined by various carbon chain lengths extending from C4 to about C-26. Carboxylic acids are defined by essentially any organic acid that includes one or more carboxyl groups (COOH). Also, the carboxylic acids can include other functional groups such as but not limited to methyl, vinyl, alkyne, amide, primary amine, secondary amine, tertiary amine, azo, nitrile, nitro, nitroso, pyrifyl, carboxyl, peroxy, aldehyde, ketone, primary imine, secondary imine, ether, ester, halogen isocyanate, isothiocyanate, phenyl, benzyl, phosphodiester, sulfhydryl, but still maintaining insolubility in the cleaning liquid 107.

Additionally, the surface functionality of the solid component 109 materials can be influenced by the inclusion of moieties (or functional groups) that are miscible with the cleaning liquid 107, such as carboxylate, phosphate, sulfate groups, polyol groups, ethylene oxide, etc. The point to be understood is that the solid components 109 should be dispersible in a substantially uniform manner throughout the cleaning liquid 107 such that the solid components 109 avoid clumping together into a form that cannot be forced to interact with the contaminants 103 present on the substrate 105.

It should be understood that the cleaning liquid 107 could be modified to include ionic or non-ionic solvents and other chemical additives. For example, the chemical additives to the cleaning liquid 107 can include any combination of co-solvents, pH modifiers, chelating agents, polar solvents, surfactants, ammonium hydroxide, hydrogen peroxide, hydrofluoric acid, tetramethylammonium hydroxide, and rheology modifiers such as polymers, particulates, and polypeptides.

Figure 1E:
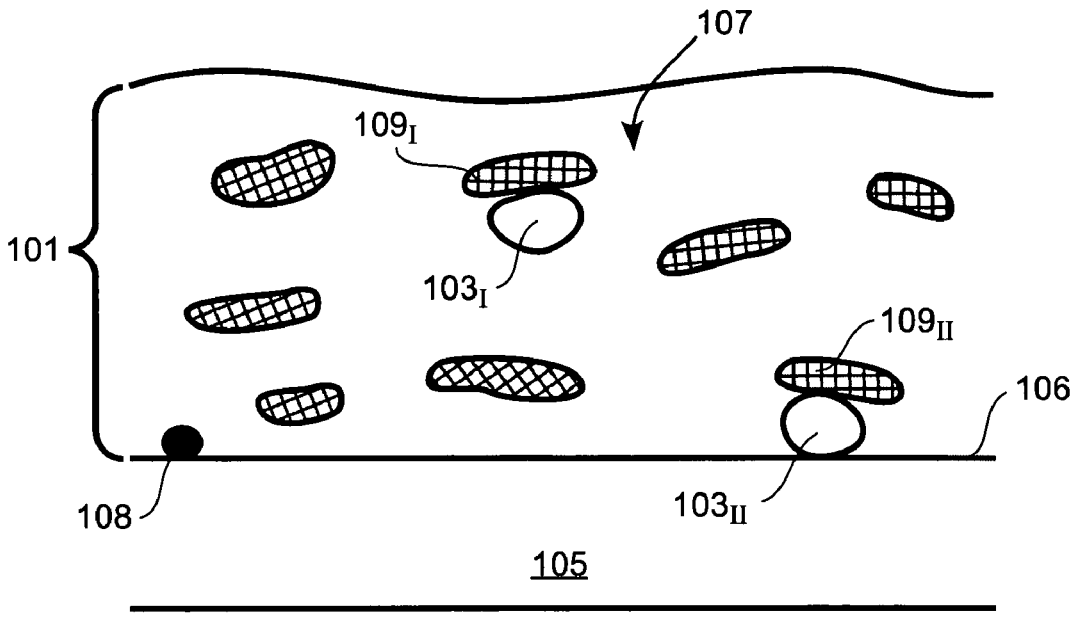
FIG. 1E shows a physical diagram of deposition of an impurity and re-deposition of a contaminant that was previously removed on the substrate surface, in accordance with one embodiment of the present invention.

As described above, FIG. 1D shows when the solid components $\mathbf{109}_I$ and $\mathbf{109}_{II}$ are moved away from the substrate surface 106, and the contaminants $\mathbf{103}_I$ and $\mathbf{103}_{II}$ bound to the solid components $\mathbf{109}_I$ and $\mathbf{109}_{II}$ are also moved away from the substrate surface 106. Sometimes before the contaminants are removed from the substrate surface along with the attached solid components, such as $\mathbf{103}_I$ and $\mathbf{109}_I$, and $\mathbf{103}_{II}$ and $\mathbf{109}_{II}$ of FIG. 1D, some contaminants, such as contaminant $\mathbf{103}_{II}$, can fall back on substrate surface 106. Further, come impurities, such as impurity 108, in the cleaning material 101 can also fall on substrate surface 106. Impurities, such as impurity 108, can be introduced into the cleaning material 101 by coming with the chemical(s) for the solid components and/or cleaning liquid used to make the cleaning material, or during preparation process. FIG. 1E shows that the contaminant $\mathbf{103}_{II}$, still attached to solid components $\mathbf{109}_{II}$, fall back on substrate surface 106 after being lifted off the substrate surface 106 as shown in FIG. 1D. FIG. 1E also shows an impurity 108, which is part of the cleaning solution 101, deposited (or fall) on the substrate surface 106. The re-deposition of the contaminant $\mathbf{103}_{II}$ and the deposition of impurity 108 reduced the particle removal efficiency (PRE) of the cleaning solution.

Re-deposited contaminants and/or deposition of impurities can stay on the substrate surface after the cleaning solution 101 is removed from the substrate surface 106. The contaminants and/or impurities that stay on the substrate surface could make the devices within the vicinity of the contaminants and/or impurities inoperable and thus reduce the yield of the substrate. Therefore, it is desirable to suspend or keep the contaminants that are removed from the substrate surface and/or impurities mixed in the cleaning liquid 107 in the cleaning liquid 107 (or cleaning material 101) to prevent them from falling back on the substrate surface.

Details of cleaning materials with solid components in a cleaning liquid can be found in U.S. patent application Ser. No. 11/519,354, filed on Sep. 11, 2006, and entitled "Method and System Using a Two-Phases Substrate Cleaning Compound," which is incorporated herein by reference for all purposes.

Figure 1F:
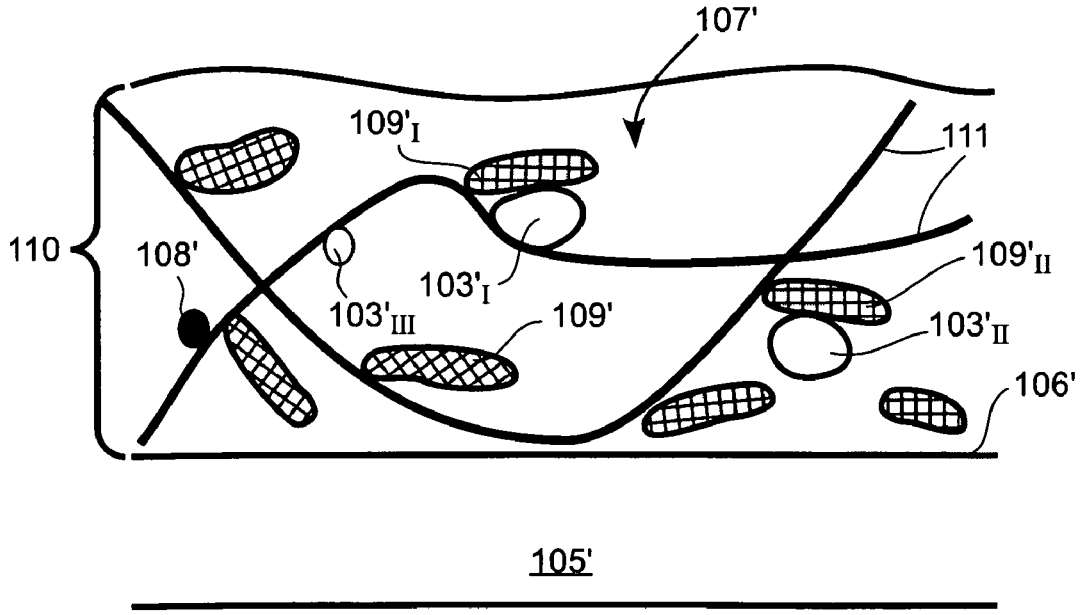
FIG. 1F shows a physical diagram of a cleaning material with solid components and polymers, in accordance with one embodiment of the present invention.

FIG. 1F shows a cleaning solution (or cleaning material, or cleaning compound) 110 that could keep contaminants and/or impurities in the cleaning liquid 107' or in the cleaning material 110, in accordance with one embodiment of the present invention. In one embodiment, the cleaning material 110 is a liquid solution. In another embodiment, the cleaning material 110 is a gel. In yet another embodiment, the cleaning material 110 is a sol. The cleaning material (or solution) 110 has a cleaning liquid 107' and solid components 109' that are made of similar materials of cleaning liquid 107 and solid components 109 of cleaning solution 101 described above. The solid components 109' can help removing contaminants 103', such as $\mathbf{103}_I'$ and $\mathbf{103}_{II}'$, off the substrate surface 106' in a manner similar to cleaning solution 101 being able to remove contaminants 103, such as $\mathbf{103}_I$ and $\mathbf{103}_{II}$, described above. In addition, the cleaning solution 110 contains polymers 111 with large molecular weight dissolved in the cleaning liquid 107', in accordance with one embodiment of the present invention. The polymers 111 are made of a polymeric compound with large molecular weight, such as greater than 10,000 g/mol or 100,000 g/mol, in accordance with one embodiment of the present invention. The polymers 111 form long polymer chains and polymeric network to capture and trap the removed contaminants, such as contaminants $\mathbf{103}_I$ and $\mathbf{103}_{II}$, to prevent the contaminants from returning back to the substrate surface 106'. The long polymer chains and polymeric network formed by the polymers 111 also can capture and trap impurities 108' and solid components 109' to prevent them from falling on the substrate surface 106'. The polymers can also help remove the contaminants 103' by attaching to the contaminants 103', such as $\mathbf{103}_{III}'$, on the substrate surface 106'. In one embodiment, the contaminants 103' on the substrate surface attach to the solvated polymers by ionic force, van der Waals force, electrostatic force, hydrophobic interaction, steric interaction, or chemical bonding when the polymer molecules come in vicinity of the contaminants. The polymers 111 capture and entrap the contaminants 103', such as $\mathbf{103}_I'$, $\mathbf{103}_{II}'$, and $\mathbf{103}_{III}'$.

Cleaning materials with polymers with a large molecular weight in a cleaning liquid have been described in U.S. patent application Ser. No. 12/131,654, filed on Jun. 2, 2008, and entitled "Materials for Particle Removal by Single-Phase and Two-Phase Media," which is incorporated herein by reference for all purposes. Polymers with a large molecular weight and form polymer chains or network in a cleaning material can help remove contaminants (or particles) on a substrate without damaging features on the substrate.

The polymers 111 dissolve in the cleaning liquid 107', which could contain elements that affect the pH value, and enhance the solubility of the polymers 111. The polymers dissolved in the cleaning liquid 107' can be a soft gel or become gel-like droplets suspended in the cleaning solution.

Figure 1G:
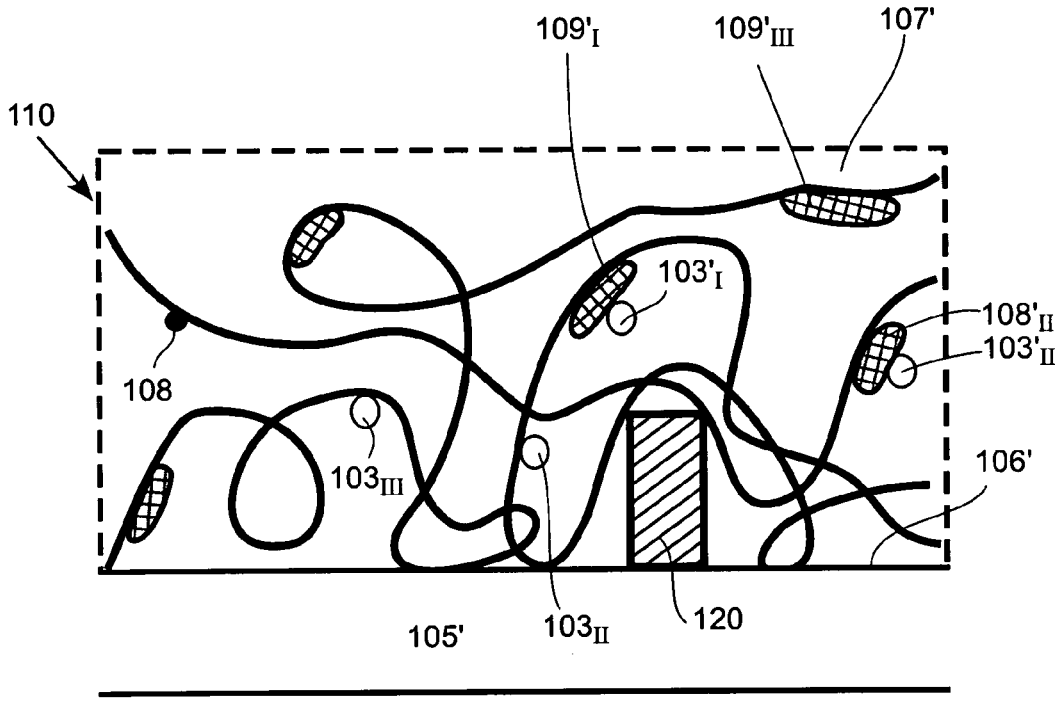
FIG. 1G shows a physical diagram of a cleaning material with solid components and polymers on a substrate surface with a protruding surface feature 120, in accordance with one embodiment of the present invention.

FIG. 1G shows the cleaning material 110 that is applied on the substrate surface, in accordance with one embodiment. The cleaning material 110 has a network of polymers 110, which capture and entrap contaminants 103', solid components 109', and impurities 108'. In one embodiment, both the polymers 111 and solid components 109' assist in removing contaminants 103' from the substrate surface 106'. In another embodiment, the solid components 109' removes the contaminants 103' off the substrate surface and the polymers 111 capture and entrap the contaminants 103' that have been removed from the substrate surface 106' by the solid components 109' in the cleaning material 110. FIG. 1G shows that numerous chains of polymers 111 are dispersed in the cleaning liquid 107' and contaminants, such as $\mathbf{103}_I'$, $\mathbf{103}_{II}'$, $\mathbf{103}_{III}'$, and $\mathbf{103}_{IV}'$ are attached to the polymer chains directly or indirectly through solid components 109', such as $\mathbf{109}_I'$, and $\mathbf{109}_{II}'$. In addition, solid components 109', such as $\mathbf{109}_{III}'$ and impurities, such as 108', can attach to the polymer chains and be kept away from the substrate surface 106'.

As mentioned above, the polymers of a polymeric compound with large molecular weight form a network in the cleaning liquid 107'. In addition, the polymers of a polymeric compound with large molecular weight are dispersed in the cleaning liquid 107'. The cleaning material 110, with the polymers 111 and solid components 109', is gentle on the device structures, such as structure 120, on the substrate during cleaning process. The polymers 111 in the cleaning material 110 can slide (or glide) around the device structures, such as structure 120, as shown in FIG. 1G, without making a forceful impact on the device structure 120. This is in contrast to hard brushes, and pads mentioned above that would make unyielding contacts with the device structures and damage the device structures. Problems associated with other cleaning methods and systems that employ forces (or energy) generated by cavitation in megasonic cleaning and high-speed impact by liquid during jet spray that would damage the structures on a substrate, such as structure 120, do not occur by using cleaning material 110. When the polymers in the cleaning material 110 are removed from the substrate surface, such as by rinsing, the contaminants attached to the polymers chains are removed from the substrate surface along with the polymer chains.

As described above, the polymers of a polymeric compound with large molecular weight are dispersed in the cleaning solution. Examples of the polymeric compound with large molecular weight include, but not limited to, acrylic polymers such as polyacrylamide (PAM), and polyacrylic acid (PAA), such as Carbopol 940™ and Carbopol 941™, poly-(N,N-dimethyl-acrylamide) (PDMAAm), poly-(N-isopropyl-acrylamide) (PIPAAm), polymethacrylic acid (PMAA), polymethacrylamide (PMAAm); polyimines and oxides, such as polyethylene imine (PEI), polyethylene oxide (PEO), polypropylene oxide (PPO) etc; Vinyl polymers such as Polyvinyl alcohol (PVA), polyethylene sulphonic acid (PESA), polyvinylamine (PVAm), polyvinyl-pyrrolidone (PVP), poly-4-vinyl pyridine (P4VP), etc; cellulose derivatives such as methyl cellulose (MC), ethyl-cellulose (EC), hydroxyethyl cellulose (HEC), carboxymethyl cellulose (CMC), etc; polysaccharides such as acacia (Gum Arabic), agar and agarose, heparin, guar gum, xanthan gum, etc; proteins such as albumen, collagen, gluten, etc. To illustrate a few examples of the polymer structure, polyacrylamide is an acrylate polymer ($—CH_2CHCONH_2—$)n formed from acrylamide subunits. Polyvinyl alcohol is a polymer ($—CH_2CHOH—$)m formed from vinyl alcohol subunits. Polyacrylic acid is a polymer ($—CH_2═CH—COOH—$)o formed from acrylic acid subunits. "n", "m", and "o" are integers. The polymers of a polymeric compound with large molecular weight either is soluble in an aqueous solution or is highly water-absorbent to form a soft gel in an aqueous solution. In one embodiment, the polymers are hydrophilic.

Contaminants 103' can be removed by cleaning material 110 by mechanisms discussed above in FIG. 1G. In one embodiment, the polymers act as a flocculant that cause the particles (or contaminants) from the substrate surface and solids in the cleaning material to come out of the solution to become floe or flakes, which is a mass formed by aggregation of fine suspended particles. Examples of polymeric flocculants include polyethylene oxide (PEO), polyacrylamide (PAM), polyacrylic acid (PAA), and chitosan, which is a form of polysaccharide, poly(diallyldimethylammonium chloride), poly(epichlorohydrin-co-ethylenediamine), and poly (dimethylamine-co-epichlorohydrin-co-ethylenediamine). Flocculants, polymeric or non-polymeric, can be made by a mixture of more than one type of flocculants. In another embodiment, the polymers do not act as a flocculant.

In one embodiment, the molecular weight of the polymeric compound is greater than 100,000 g/mol. In another embodiment, the molecular weight of the polymeric compound is between about 0.1M g/mol to about 100M g/mol. In another embodiment, the molecular weight of the polymeric compound is between about 1M g/mol to about 20M g/mol. In yet another embodiment, the molecular weight of the polymeric compound is between about 15M g/mol to about 20M g/mol. The weight percentage of the polymers in the cleaning material is between about 0.001% to about 20%, in one embodiment. In another embodiment, the weight percentage is between about 0.001% to about 10%. In another embodiment, the weight percentage is between about 0.01% to about 10%. In yet another embodiment, the weight percentage is between about 0.05% to about 5%. The polymers can dissolve in the cleaning solution, be dispersed completely in the cleaning solution, form liquid droplets (emulsified) in the cleaning solution, or form lumps in the cleaning solution.

More than one type of polymer can be dissolved in the cleaning solution to formulate the cleaning material. For examples the polymers in the cleaning material can include an "A" polymeric compound and a "B" polymeric compound. Alternatively, the polymers can be copolymers, which are derived from two or more monomeric species. For example, the copolymers can include 90% of PAM and 10% of PAA and are made of monomers for PAM and PAA. In addition, the polymers can be a mixture of two or more types of polymers. For example, the polymers can be made by mixing two types of polymers, such as 90% of PAM and 10% of PAA, in the solvent.

In the embodiments shown in FIG. 1G, polymers of a polymeric compound with large molecular weight are dissolved uniformly in the cleaning liquid 107'. The base liquid, or solvent, of the cleaning liquid (or cleaning solution) 107' can be any polar liquid, such as water ($H_2$). For polymers with polarity, such as PAM, PAA, or PVA, the suitable solvent for the cleaning solution is a polar liquid, such as water ($H_2O$). Other examples of solvent include isopropyl alcohol (IPA), dimethyl sulfoxide (DMSO), and dimethyl formamide (DMF). In one embodiment, the solvent includes more than one liquid and is a mixture of two or more liquid.

In another embodiment, the cleaning solution includes compounds other than the solvent, such as water, to modify the property of the cleaning material, which is formed by mixing the polymers in the cleaning solution. For example, the cleaning solution can include a buffering agent, which can be a weak acid or a weak base, to adjust the potential of hydrogen (pH) value of the cleaning solution and cleaning material formed by the cleaning solution. One example of the weak acid is citric acid. One example of the weak base is ammonium ($NH_4OH$). The pH values of the cleaning materials are between about 1 to about 12. In one embodiment, for front-end applications (before the deposition of copper and inter-metal dielectric), the cleaning material is basic. The pH values for front-end applications are between about 7 to about 12, in one embodiment. In another embodiment, the pH values for front-end applications are between about 8 to about 11. In yet another embodiment, the pH values for front-end applications are between about 8 to about 10. High pH values make the substrate surface negatively charged, which makes the substrate surface repel solid components 109', which are also negatively charged at high pH.

For backend processing (after deposition of copper and inter-metal dielectric), the cleaning solution is slightly basic, neutral, or acidic, in one embodiment. Copper in the backend interconnect is not compatible with basic solution with ammonium, which attacks copper. The pH values for backend applications are between about 1 to about 7, in one embodiment. In another embodiment, the pH values for backend applications are between about 1 to about 5. In yet another embodiment, the pH values for backend applications are between about 1 to about 2. In another embodiment, the cleaning solution includes a surfactant, such as ammonium dodecyl sulfate (ADS) to assist dispersing the polymers in the cleaning solution. In one embodiment, the surfactant also assist wetting of the cleaning material on the substrate surface. Wetting of the cleaning material on the substrate surface allows the cleaning material to come in close contact with the substrate surface and the particles on the substrate surface. Wetting improves cleaning efficiency. Other additives can also be added to improve surface wetting, substrate cleaning, rinsing, and other related properties.

Examples of cleaning solution include a buffered ammonium solution (BAS), which include basic and acidic buffering agents, such as 0.44 wt % of $NH_4OH$ and 0.4 wt % of citric acid, in the solution. Alternatively, the buffered solution, such as BAS, includes some amount of a surfactant, such as 1 wt % of ADS, to help suspend and disperse the polymers in the cleaning solution. A solution that contains 1 wt % of ADS, 0.44 wt % of NH3, and 0.4 wt % of citric acid is called solution "100". Both solution "100" and BAS have a pH value of about 10.

Table I shows particle removal efficiency (PRE) and number of particles (or contaminants) being added for various cleaning materials. The cleaning materials are prepared by mixing 4% ammonium stearate acid (as solid components) in cleaning solution 100 as defined above, and 0.2% (weight %) 15-20M g/mol poly(acrylamind-co-acrylic acid) in cleaning solution 100 as defined above. Some of the cleaning materials contain only solid components and cleaning liquid and some contain only polymers and cleaning liquid. For cleaning materials that contain all three components (i.e. solid components, polymers and cleaning liquid), the cleaning materials can be made by pre-mix the fatty acid with water and polymers with water separately first and then mix the pre-mixture together. Alternatively, the cleaning materials with all three components can be made by mixing either fatty acid or polymers with water first and then mix in the third component. In another embodiment, the three components can be mixed together at the same time.

PRE is measured by using particle monitor substrates, which are purposely deposited with silicon nitride particles with varying sizes. In this study, only particle sizes between 90 nm and 1 μm are measured. PRE is calculated by equation (1) listed below:

$$PRE=(\text{Pre-clean counts}-\text{Post-clean counts})/\text{Pre-clean counts} \quad (1)$$

The substrates with SiN particles are pre-scanned to measure the particle counts and to obtain a particle map to be compared with substrates after substrate cleaning. If particles show up on locations on the substrate that do not have particles before substrate cleaning, these particles are considered as "adders". "Adders" can be contaminants on the substrate surface that have been moved to new locations or particles (contaminants or impurities) from the cleaning materials that are deposited on the substrate surface.

TABLE I

Particle removal efficiency (PRE) for different cleaning materials.

| Cleaning Material No. | Fatty Acid (%) | Polymers (ppm) | PRE (%) | Number of Adders |
|---|---|---|---|---|
| #1 | 4.0 | 0 | 92 | 273 |
| #2 | 2.0 | 0 | 70 | 288 |
| #3 | 2.0 | 1000 | 96 | 36 |
| #4 | 2.0 | 500 | 98 | 24 |
| #5 | 2.0 | 250 | 96 | 30 |
| #6 | 3.0 | 500 | 98 | 27 |
| #7 | 3.8 | 100 | 98 | 27 |
| #8 | 4.0 | 20 | 96 | 35 |
| #9 | 0.0 | 1000 | 94 | 9 |
| #10 | 0.0 | 500 | 81 | 24 |

The data in table I show that cleaning materials #1 and #2 that are made purely of the fatty acid (solid components) and water (cleaning liquid) has good cleaning efficiencies (or PRE) (94% for #1 and 70% for #2). However, the number of adders are fairly high (>250). However, if some amount of polymers are added to the cleaning materials, not only the adders numbers are greatly reduced, the PRE is also improved. This can be seen by comparing the cleaning data of cleaning materials #1 and #2 with cleaning data of cleaning materials #3 to #10. The data show that adding polymers to the cleaning materials greatly reduces the adder counts from greater than 250 to less than 40. Adding the polymers to the cleaning materials also improve PRE. This can be seen by comparing cleaning materials #2 with #3, #4, and #5. These four cleaning materials all have 2% fatty acid and varying amount of polymers from 250 ppm to 1000 ppm. PRE for cleaning materials with 2% fatty acid greatly improves from 70% to about 96-98% with the addition of polymers. Even the addition of a small amount of polymer, such as 250 ppm, would be sufficient to improve the PRE and to reduce the adder counts.

The role of the fatty acid could be significant at certain concentration of polymers. Cleaning materials #3 and #9, which both have polymers at 1000 ppm concentration, the PREs for these two cleaning materials are quite close, 96% for #3 and 94% for #9. The number of adders are slightly higher for the cleaning material with 2% fatty acid, 36 adders versus 9 adders. The PREs for cleaning materials #4 and #10, both with 500 ppm of polymers, show that adding 2% fatty acid improves PRE from 81% to 98%. The results show that fatty acid help in improving PRE and the PRE improvement is more significant at certain concentration of polymers, such as 500 ppm.

The experimental results in Table I also show that with the addition of the polymers in the cleaning materials, PREs do not vary with the concentration of fatty acid between 2% to 4%. PREs of cleaning materials #4 (2% fatty acid) and #6 (3% fatty acid), both have 500 ppm polymers, are both about 98%. Further, PREs of cleaning materials #2, #3, #4, #5, #6, #7, and #8 are all between about 96% to about 98%. The data in Table I show that fatty acid at 2-4% and concentration of polymers between about 20 ppm to about 1000 ppm can clean substrates with high PRE, between about 96% to about 98%, and with low adders, between about 27 to about 36.

The results in Table I show that adding polymers in the cleaning material greatly reduces the adders and also improves PRE. The polymeric chains and network help capture and entrap particles on the substrate surface and in the cleaning liquid and prevent them from being deposited or re-deposited on the substrate surface. The results in Table I also show that solid components play a role in cleaning contaminants on the substrate surface.

Figure 2A:
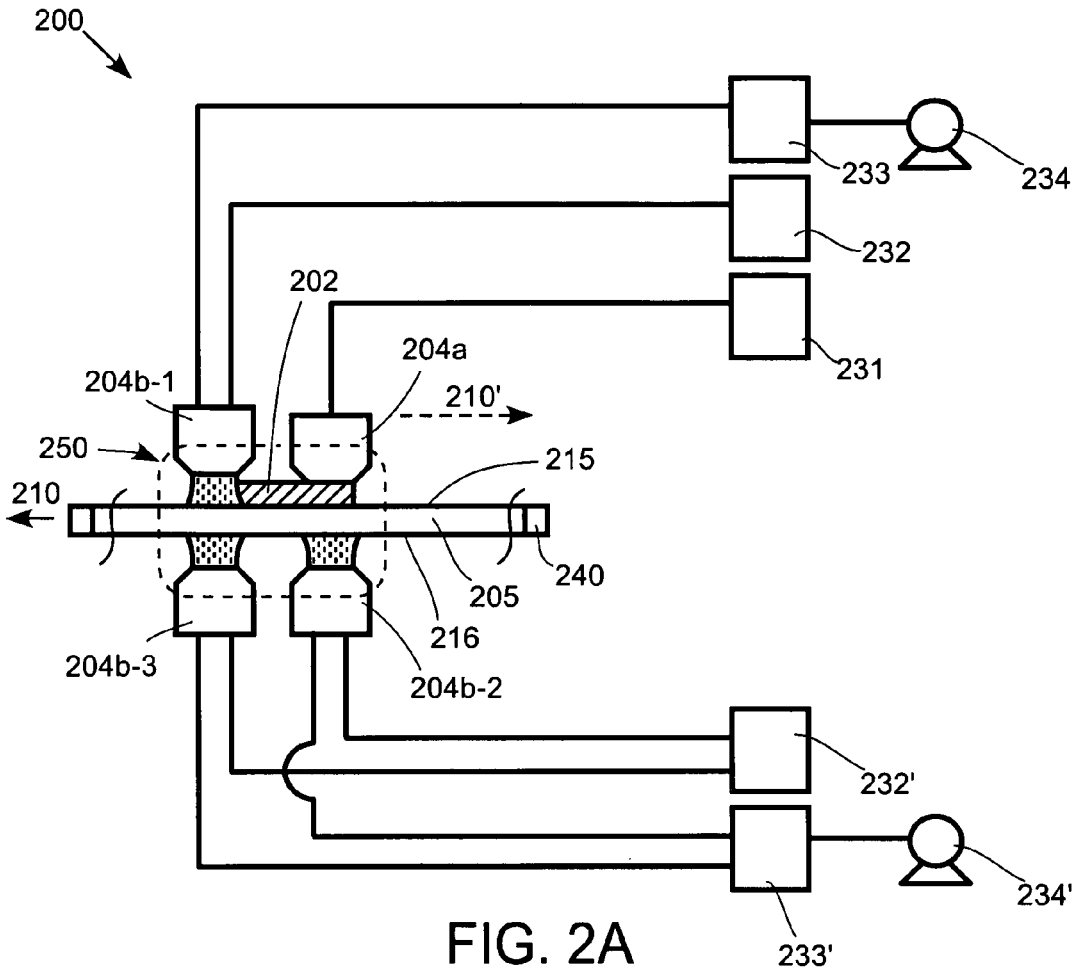
FIG. 2A shows a schematic diagram of an apparatus for cleaning contaminants from a substrate surface, in accordance with one embodiment of the present invention.

FIG. 2A shows an apparatus 200 for cleaning a substrate 250, in accordance with one embodiment of the present invention. The apparatus 200 includes a cleaning material dispense head 204*a* for dispensing a cleaning material on a surface 215 of the substrate 205. The cleaning material dispense head 204*a* is coupled to a cleaning material storage 231. In one embodiment, the cleaning material dispense head 204*a* is held in held in proximity (proximity head) to the surface 215 of the substrate 205 by an arm (not shown). Details of an exemplary apparatus for cleaning substrate using a proximity head(s) can be found in U.S. patent application Ser. No. 12/165,577, filed on Jun. 30, 2008, and entitled "Single Substrate Processing Head for Particle Removal Using Low Viscosity Fluid," Which is incorporated herein by reference in its entirety.

The apparatus also includes an upper rinse and dry head 204*b*-1 for rinsing and drying the surface 215 of the substrate 205. The upper rinse and dry head 204*b*-1 is coupled to a rinse liquid storage 232, which provides the rinse liquid for rinsing the substrate surface 215 covered by a film of cleaning material 202 dispensed by the cleaning material dispense head 204*a*. In addition, the upper rinse and dry head 204*b*-1 is coupled to a waste storage 233 and a vacuum 234. The waste storage 233 contains a mixture of cleaning material with contaminants removed from the substrate surface 215 and rinse liquid dispensed by the upper rinse and dry head 204*b*-1.

In one embodiment, substrate 205 moves under the cleaning material dispense head 204*a* and upper rinse and dry head 204*b*-1 in the direction 210. The surface 215 of substrate 205 is first covered with the film of cleaning material 202 and then rinsed and dried by the upper rinse and dry head 204*b*-1. Substrate 205 is held by a substrate holder 240. Alternatively, substrate 205 can be held steady (not moving) and the cleaning material dispense head 204*a* and upper rinse and dry head 204*b*-1 move in the direction 210', which is opposite to the direction 210.

In one embodiment, the cleaning material dispense head 204*a* and the rinse and upper dry head 204*b*-1 belong to two separate systems. Cleaning material is dispensed on the substrate 205 in a first system with the cleaning material dispense head and then moved to a second system with a rinse and dry apparatus. The rinse and dry apparatus can be an apparatus, such as rinse and dry head 204*b*-1, or other type of rinse and dry apparatus.

In one embodiment, below the substrate 205, there are two lower rinse and dry heads 204*b*-2 and 204*b*-3 to clean the other surface 216 of substrate 205. In one embodiment, the two lower rinse and dry heads 204*b*-2 and 204*b*-2 are coupled to a rinse liquid storage 232' and a waste storage 233' and a vacuum (pump) 234', as shown in FIG. 2A. In another embodiment, each of the lower rinse and dry heads 204*b*-2 and 204*b*-3 are coupled to separate rinse liquid storages and separate waste storages and separate vacuum pumps. In yet another embodiment, rinse liquid storages 232 and 232' are combined into one storage, and waste storages 233 and 233' are combined into one storage. In this embodiment, vacuum pumps 234 and 234' are also combined into one vacuum pump.

In one embodiment, rinse and dry head 204*b*-2 is directly below cleaning material dispense head 204*a*, and lower rinse and dry head 204*b*-3 is directly below rinse and upper dry head 204*b*-1. In another embodiment, the positions of the lower rinse and dry heads 204*b*-2 and 204*b*-3 are not related to the positions of cleaning material dispense head 204*a* and upper rinse and dry head 204*b*-1. In one embodiment, the upper rinse and dry head 204*b*-1, the lower rinse and dry heads 204*b*-2 and 204*b*-3 are held in held in proximity (proximity heads) to the surfaces 215 and 216, respectively, of the substrate 205 by an arm (not shown).

Figure 2B:
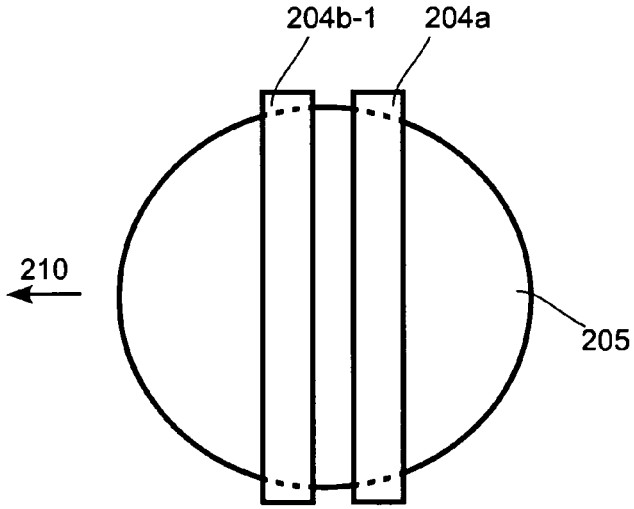
FIG. 2B shows a top schematic view of the apparatus of FIG. 2A, in accordance with one embodiment of the present invention.

FIG. 2B shows the top view of apparatus 200, in accordance with one embodiment of the present invention. The cleaning material dispense head 204*a* is parallel to the upper rinse and dry head 204*b*-1. The lower rinse and dry heads 204*b*-2 and 204*b*-3 (not shown) are below substrate 205 and cleaning material dispense head 204*a* and upper rinse and dry head 204*b*-1. In one embodiment, both the lower rinse and dry heads 204*b*-2 and 204*b*-3 are similar to the upper rinse and dry head 204*b*-1 and they are parallel to one another.

Figure 2C:
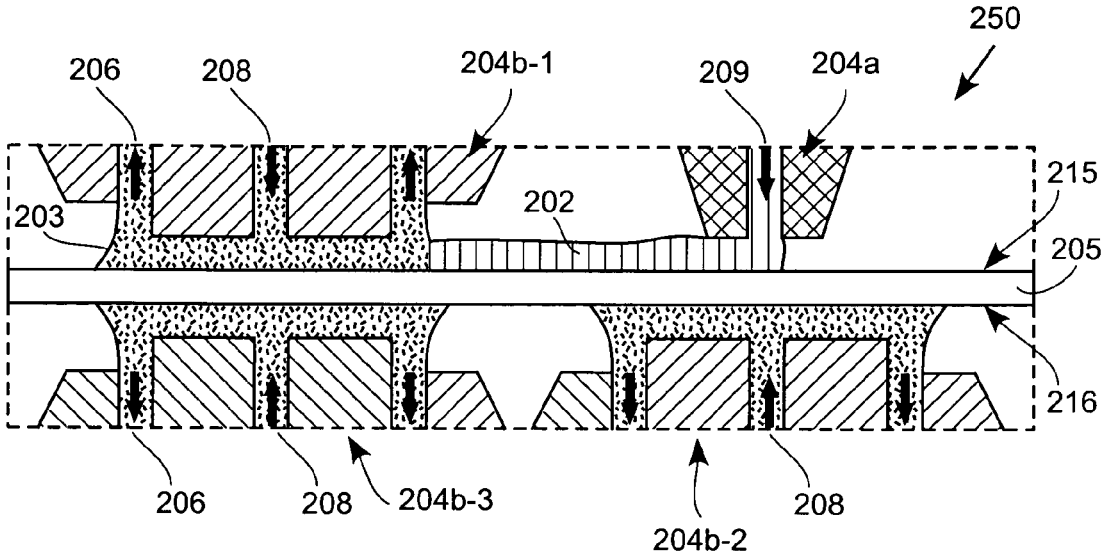
FIG. 2C shows a schematic diagram of a region 250 of FIG. 2A, in accordance with embodiment of the present invention.

FIG. 2C shows a process area 250 in FIG. 2B, in accordance with one embodiment of the present invention. The process area 250 illustrates one embodiment of fluid application to the substrate 205 from the cleaning material dispense head 204*a* and upper rinse and dry head 204*b*-1 and lower rinse and dry heads 204*b*-2 and 104*b*-3. In this embodiment, upper rinse and dry head 204*b*-1 and lower rinse and dry heads 204*b*-2 and 204*b*-3 rinse and dry the substrate 205. Upper rinse and dry head 204*b*-1 and lower rinse and dry heads 204*b*-2 and 204*b*-3 have a dispense port 208 and vacuum ports 206. In one embodiment, dispense port 208 is used to apply a rinse liquid, such as de-ionized water, to the substrate 205. A vacuum is drawn through vacuum ports 206 to remove fluid applied via dispense port 208. The fluid removed through the vacuum ports includes rinse liquid, cleaning material, and contaminants removed along with the cleaning material. Other types of rinse liquid can also be applied through disport 208 to rinse substrate 205.

FIG. 2C also shows the cleaning material dispense head 204*a* applying a film 202 of cleaning material 101 to the substrate 205. In one embodiment, the cleaning material dispense head 204*a* provides uniform flow delivery across the substrate 205. As described above, in one embodiment, the substrate 205 moves in the direction 210 between the upper applicator 204*a* and lower applicator 204*b*-2. Depending on the type of cleaning material being delivered and the speed of the substrate under the cleaning material dispense head 204*a*, cleaning material can be supplied to the substrate 205 through dispense port 209 at a speed between about 20 cc/min to 500 cc/min, in accordance with one embodiment of the present invention. The cleaning material dispense head 204*a* dispenses a film 202 of cleaning material 101 when turned on. In one embodiment, the fluid surface tension of the cleaning material prevents dripping or leaking of the cleaning material from the upper applicator 204*a* when the flow of the cleaning material through the manifold (not shown) is turned off. Under the rinse and dry head, there is a volume 203 of material, which consists rinse liquid, cleaning material and contaminants removed from the substrate surface.

In one embodiment, the cleaning material dispense head 204*a* in FIGS. 2A-2C, through the action of dispensing of the cleaning material, provides a down-ward force to cleaning material and to the substrate surface. The cleaning material can be pressed out of the cleaning material dispense head 204*a* by air pressure or by a mechanical pump. In another embodiment, the applicator 204*a* provides a down-ward force on the cleaning material on the substrate surface by a down-ward mechanical force. In one embodiment, the movement of the substrate 205 under the applicator 204*a* in the direction 210, provides a sheer force to the cleaning material and to the substrate surface. The downward and sheer forces assist the cleaning material in removing contaminants from the substrate surface 215.

Figure 2D:
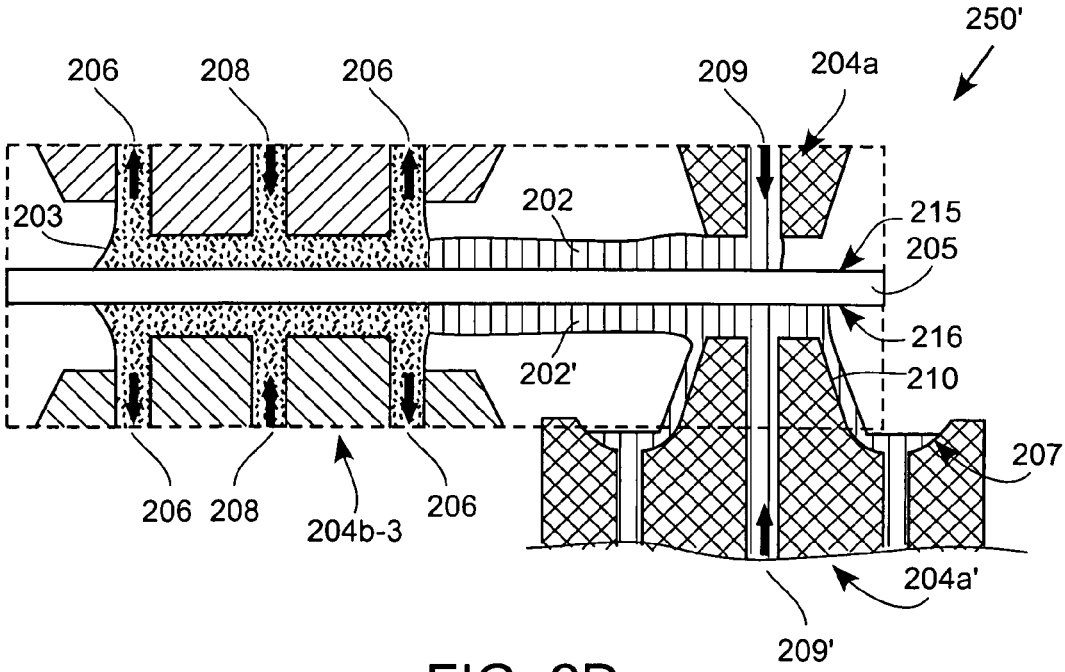
FIG. 2D shows a schematic of a diagram a process area 250', which is similar to the process area 250 of FIG. 2A, in accordance with one embodiment of the present invention.

FIG. 2D shows a schematic of a diagram a process area 250', which is similar to the process area 250 of FIG. 2A, in accordance with one embodiment of the present invention. In this embodiment, there are an upper cleaning material dispense head 204*a* and a lower cleaning material dispensing head 204*a'*. The upper cleaning material dispensing head 204*a* has been described above in FIGS. 2A-2C. The lower cleaning material dispensing head 204*a'* also dispenses a film 202' of a cleaning material 101' on the lower side of substrate 205. The lower cleaning material dispensing head also has a dispense port 209' for dispensing the cleaning material 101'. The dispensed cleaning material 101' forms a film 202' on the lower side of substrate 205. In this embodiment, the lower cleaning material dispensing head 204*a'* applies a film 202' of cleaning material 101' to the lower surface 216 of substrate 205 in a similar fashion to previously discussed upper cleaning material dispensing head 204*a*. In one embodiment, cleaning materials 101 and 101' are identical while in another embodiment, cleaning materials 101 and 101' are different.

Some of the cleaning material flows to the sidewall of the lower dispense head 210 of dispense port 209' to form a film 203'. At the lower end of the dispense port 209' there is a collector 207 for collecting cleaning material that flow to the side wall 210 surrounding dispense port 209' of the lower dispense head 209'. In one embodiment, the collector 207 has a wider opening near the top with a narrow channel near the bottom. In one embodiment, the upper dispense head 204*a* and lower dispense head 204*a'* are both coupled to the cleaning material storage 231, shown in FIG. 2A, if cleaning material 101 is the same as cleaning material 101'. In another embodiment the lower dispense head 204*a'* is coupled to another storage (not shown) of cleaning material 101', which can be the same as or different from cleaning material 101. The over-flown cleaning material collected by collector 207 can be supplied to the cleaning material storage used to supply cleaning material 101' to dispense port 209' or to a different cleaning material storage (not shown).

Upper rinse and dry head **204*b*-1 and lower rinse and dry head 204*b*-3 in FIG. 2D are similar to the applicators 204*b*-1 and 204*b*-3 described in FIGS. 2A and 2C. The substrate 205 is cleaned and dried as it passes between upper applicator 104*b*-1 and lower applicator 104*b*-3. A rinse agent 204 is applied to the substrate 205 through ports 208. In one embodiment, the rinse agent 204 is de-ionized water. In another embodiment, the rinse agent 204 is a mixture of deionzied water and isopropyl alcohol. A vacuum is drawn through ports 206 to remove the rinse agent 204 along with fluids 202 and 202' from the substrate 205**.

Figure 2E:
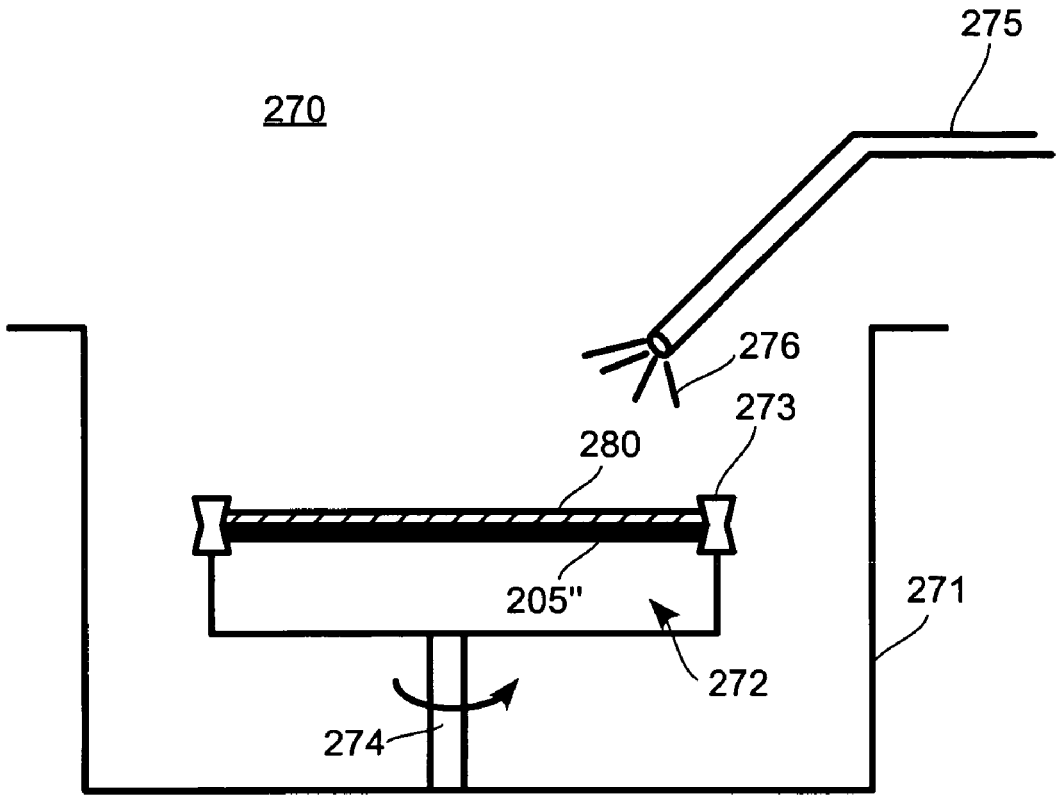
FIG. 2E shows a schematic diagram of a rinse and dry apparatus 270, in accordance with one embodiment of the present invention.

Alternatively, the cleaning apparatus 2A does not have rinse and dry heads **204*b*-1, 204*b*-2, and 204*b*-3. After the cleaning material has been applied on substrate 205. The substrate can be moved to another apparatus for rinsing and drying. FIG. 2E shows a schematic diagram of an embodiment of a rinse and dry apparatus 270. Apparatus 270 has a container 271 that houses a substrate support assembly 272. The substrate support assembly 272 has a substrate holder 273 that supports a substrate 205", which has a layer 280 of cleaning material 101. The substrate support assembly 272 is rotated by a rotating mechanism 274. The apparatus 270 includes a rinse liquid dispenser 320, which can dispense rinse liquid 276 on the substrate surface to clean the substrate surface of the cleaning material. In one embodiment, the rinse liquid is de-ionized water (DIW). In another embodiment, the dispenser 275 dispenses a rinsing solution, such as $NH_4OH$ in DIW, on the substrate surface to hydrolyze the cleaning material to enable the cleaning material to be lifted off the substrate surface. Afterwards, the same dispenser 270** or a different dispenser (not shown) can dispense DIW to remove the cleaning solution from the substrate surface.

Figure 3A:
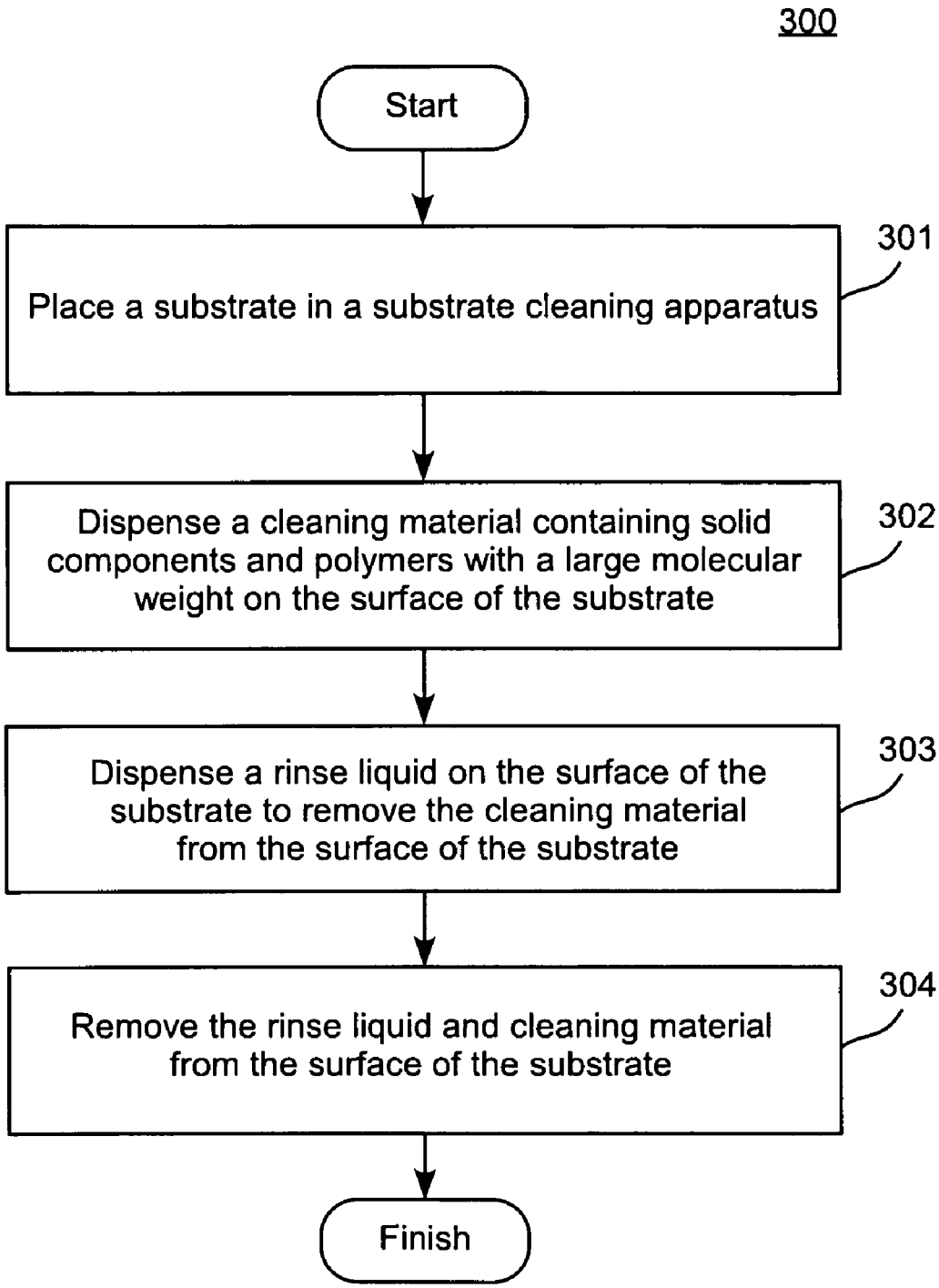
FIG. 3A shows a process flow of using a cleaning material to clean a substrate surface, in accordance with one embodiment of the present invention.

FIG. 3A shows a process flow 300 of cleaning a substrate using a cleaning material containing solid components and polymers of a polymeric compound with large molecular weight, in accordance with one embodiment of the present invention. In one embodiment, the substrate is a patterned substrate with features protruding from the substrate surface. In another embodiment the substrate is a blank wafer without patterns. The chemicals in the cleaning material have been described above. At operation 301, a substrate to be cleaned is place in a cleaning apparatus. At operation 302, the cleaning material is dispensed on the surface of the substrate. At mentioned above, the cleaning material contains solid components and polymers with large molecular weight, both of which are mixed in a cleaning liquid. At operation 303, a rinse liquid is dispensed on the surface of the patterned substrate to rinse off the cleaning material. The rinse liquid is described above. At operation 304, the rinse liquid and the cleaning material are removed from the surface of the substrate. In one embodiment, after the rinse liquid is applied on the substrate surface, the rinse liquid, the cleaning material, and the contaminants on the substrate surface are removed from the surface of the patterned substrate by vacuum. The contaminants on the patterned substrate to be removed can be essentially any type of surface contaminant associated with the semiconductor wafer fabrication process, including but not limited to particulate contamination, trace metal contamination, organic contamination, photoresist debris, contamination from wafer handling equipment, and wafer backside particulate contamination. The substrate cleaning method described in the process flow 300 also includes applying a force to the solid components to bring the solid component within proximity to a contaminant present on the substrate, such that an interaction is established between the solid components and the contaminants. In one embodiment, the force is applied on the solid components when the cleaning material is dispensed on the substrate surface. In another embodiment, the force is applied on the solid component when the cleaning material is dispensed on the substrate surface and also when the rinse liquid is applied on the substrate surface. In this embodiment the force applied on the substrate surface during rinsing also help to bring the solid components closer to the contaminants to establish an interaction between the solid components and the contaminants.

Additionally, in one embodiment, the process flow 300 can include an operation for controlling a temperature of the cleaning material to enhance interaction between the solid component and the contaminant. More specifically, the temperature of the cleaning material can be controlled to control the properties of the solid component. For example, at a higher temperature the solid component may be more malleable such that it conforms better when pressed against the contaminant. Then, once the solid component is pressed and conformed to the contaminant, the temperature is lowered to make the solid component less malleable to better hold its conformal shape relative to the contaminant, thus effectively locking the solid component and contaminant together. In addition, the temperature may also be used to control the solubility and therefore the concentration of the solid components. For example, at higher temperatures the solid component may be more likely to dissolve in the cleaning liquid. The temperature may also be used to control and/or enable formation of solid components in-situ on the substrate from liquid-liquid suspension.

In one embodiment, the method includes an operation for controlling a flow rate of the cleaning material over the substrate to control or enhance movement of the solid cleaning material and/or contaminant away from the substrate. The method of the present invention for removing contamination from a substrate can be implemented in many different ways so long as there is a means for applying a force to the solid components of the cleaning material such that the solid components establish an interaction with the contaminants to be removed.

Alternatively, before the operation 303 of substrate rinse, the substrate with the cleaning material, that contains dislodged contaminants, can be cleaned with a final clean using chemical(s) that facilitates the removal of all the cleaning material along with the contaminants from the substrate surface. For example, if the cleaning material contains carboxylic acid solids, $NH_4OH$ diluted in DIW could be used to remove carboxylic acid off the substrate surface. $NH_4OH$ hydrolyzes (or ionizes by deprotonating) the carboxylic acid and enables the hydrolyzed carboxylic acid to be lifted off the substrate surface. Alternatively, a surfactant, such as ammonium dodecyl Sulfate, $CH_3(CH_2)_{11}OSO_3NH_4$, can be added in DIW, to remove carboxylic acid solids off the substrate surface.

The rinse liquid for the rinse operation 303 can be any liquid, such as DIW or other liquid, to remove the chemical(s) used in the final clean, if such an operation exists, or cleaning material, without the final clean operation, from the substrate surface. The liquid used in rinse operation should leave no chemical residue(s) on the substrate surface after it evaporates.

Figure 3B:
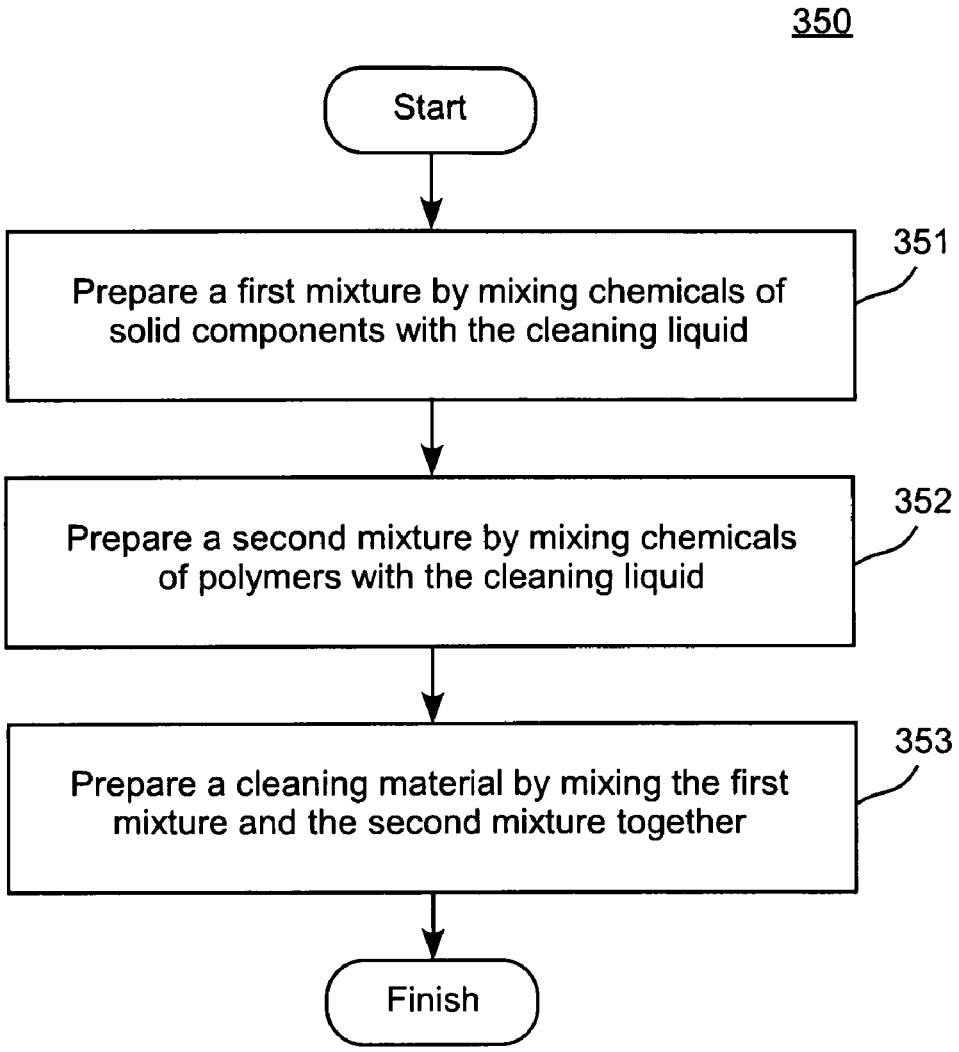
FIG. 3B shows a process flow of making a cleaning material, in accordance with one embodiment of the present invention.

FIG. 3B shows a process flow 350 of preparing a cleaning material to clean a patterned substrate, in accordance with one embodiment of the present invention. The cleaning material containing solid components and polymers of a polymeric compound with large molecular weight as described above. At operation 351, a first mixture is prepared by mixing the chemical(s) for solid components and the cleaning liquid. In one embodiment, the chemical(s) for solid components is in a powder form being mixed with the cleaning liquid to make the first mixture. In one embodiment, operation 351 also includes heating and cooling during the mixing process. At operation 352, a second mixture is prepared by mixing the chemical(s) for polymers with the cleaning liquid. In one embodiment, the chemical(s) for polymer is in a powder form being mixed with the cleaning liquid to make the second mixture. In one embodiment, operation 351 also includes heating and cooling during the mixing process. At operation 353, the first mixture and the second mixture are mixed together to make the cleaning material, which contains the solid compounds, the polymers, and cleaning liquid. In one embodiment, the polymers form a network in the cleaning material. In one embodiment, before the start of operation 351, chemicals and cleaning liquid needed for operations 351 and 352 are measured and prepared.

Additionally, in one embodiment, the process flow 350 can include an operation for controlling a temperature of the cleaning material. The temperature may be used to control the solubility and therefore the concentration of the solid components. For example, at higher temperatures the solid component may be more likely to dissolve in the cleaning liquid. The temperature may also be used to control and/or enable formation of solid components in-situ on the substrate from liquid-liquid suspension. In a separate embodiment, the process flow can include an operation for precipitating solids dissolved within the viscous liquid. This precipitation operation can be accomplished by dissolving the solids into a solvent and then adding a component that is miscible with the solvent but that does not dissolve the solid. In one embodiment, before the start of operation 351, chemicals and cleaning liquid needed for operations 351 and 352 are measured and prepared. As mentioned above, the cleaning material can also be prepared by mixing the chemicals from the solid components and polymers, and cleaning liquid in one single operation.

While this invention has been described in terms of several embodiments, it will be appreciated that those skilled in the art upon reading the preceding specifications and studying the drawings will realize various alterations, additions, permutations and equivalents thereof. Therefore, it is intended that the present invention includes all such alterations, additions, permutations, and equivalents as fall within the true spirit and scope of the invention. In the claims, elements and/or steps do not imply any particular order of operation, unless explicitly stated in the claims.

What is claimed is:

1. A cleaning material to remove contaminants from a semiconductor substrate surface, comprising:

a cleaning liquid;

a plurality of solid components being greater than zero and less than 3% of the cleaning material, the plurality of solid components being dispersed in the cleaning liquid, wherein the plurality of solid component interact with at least some of contaminants on the semiconductor substrate surface to remove the contaminants from the substrate surface; and polymers of a polymeric compound, the polymers being greater than zero and less than 500 ppm, wherein the polymers become soluble in the cleaning liquid and form the cleaning material with the cleaning liquid and the plurality of solid components, and wherein the solubilized polymers having long polymer chains capture and entrap solid components and contaminants in the cleaning liquid.

2. The cleaning material of claim 1, wherein the cleaning material deforms around device features on the surface of the patterned substrate when a force is applied on the cleaning material covering the patterned substrate, the cleaning material being applied on the surface of the patterned substrate to remove the contaminants from the surface without substantially damaging the device features on the surface.

3. The cleaning material of claim 1, wherein the solid components is made of a carboxylic acid with a weight percent in the range between about 1% to about 20%.

4. The cleaning material of claim 1, wherein the plurality of solid components are a fatty acid having carbon number greater than 4.

5. The cleaning material of claim 4, wherein the fatty acid is selected from the group consisting of lauric, palmitic, stearic, oleic, linoleic, linolenic, arachidonic, gadoleic, eurcic, butyric, caproic, caprylic, myristic, margaric, behenic, lignoseric, myristoleic, palmitoleic, nervanic, parinaric, timnodonic, brassic, clupanodonic acid and mixtures thereof.

6. The cleaning material of claim 1, wherein the cleaning liquid is selected from the group consisting of water, isopropyl alcohol (IPA), dimethyl sulfoxide (DMSO), dimethyl formamide (DMF), or a combination thereof.

7. The cleaning material of claim 1, wherein the polymeric compound is selected from the hydrophilic polymer groups consisting of acrylic polymers, such as polyacrylamide (PAM), polyacrylic acid (PAA), copolymers of PAM and PAA, poly-(N,N-dimethyl-acrylamide) (PDMAAm), poly-(N-isopropyl-acrylamide) (PIPAAm), polymethacrylic acid (PMAA), polymethacrylamide (PMAAm), polyimines and oxides, such as polyethylene imine (PEI), polyethylene oxide (PEO), polypropylene oxide (PPO), vinyl polymers, such as polyvinyl alcohol (PVA), polyethylene sulphonic acid (PESA), polyvinylamine (PVAm), polyvinyl-pyrrolidone (PVP), poly-4-vinyl pyridine (P4VP), cellulose derivatives, such as methyl cellulose (MC), ethyl-cellulose (EC), hydroxyethyl cellulose (HEC), carboxymethyl cellulose (CMC), chitosan, poly(epichlorohydrin-co-ethylenediamine), poly(dimethylamine-co-epichlorohydrin-co-ethylenediamine), polysaccharides, such as acacia, agar and agarose, heparin, guar gum, xanthan gum, and proteins such as albumen, collagen, and gluten.

8. The cleaning material of claim 1, wherein the polymers of the polymeric compound act as a flocculant.

9. The cleaning material of claim 1, further comprising:

a surfactant to assist in dispersing or wetting the polymers and solid components in the cleaning liquid.

10. The cleaning material of claim 9, wherein the surfactant is ammonium dodecyl sulfate (ADS).

11. The cleaning material of claim 1, wherein the cleaning material is fluidic in a form of a liquid, sol, or gel.

12. The cleaning material of claim 1, wherein the pH value of the cleaning material is between about 7 to about 12 for front-end applications.

13. The cleaning material of claim 1, wherein the pH value of the cleaning material is between about 1 to about 7 for backend application.

14. The cleaning material of claim 1, wherein the polymers capture and entrap impurities in the cleaning material.

15. A cleaning material to remove contaminants from a semiconductor substrate surface, comprising:

a cleaning liquid;

a plurality of solid components being greater than zero and about 2% of the cleaning material, the plurality of solid components being dispersed in the cleaning liquid, wherein the plurality of solid component interact with at least some of contaminants on the semiconductor substrate surface to remove the contaminants from the substrate surface; and polymers of a polymeric compound, the polymers being greater than zero and about 250 ppm, wherein the polymers become soluble in the cleaning liquid and form the cleaning material with the cleaning liquid and the plurality of solid components, and wherein the solubilized polymers having long polymer chains capture and entrap solid components and contaminants in the cleaning liquid.

16. A cleaning material to remove contaminants from a semiconductor substrate surface, comprising:

a cleaning liquid;

a plurality of solid components being greater than zero and about 2% of the cleaning material, the plurality of solid components being dispersed in the cleaning liquid, wherein the plurality of solid component interact with at least some of contaminants on the semiconductor substrate surface to remove the contaminants from the substrate surface; and polymers of a polymeric compound, the polymers being greater than zero and between 250 ppm and 500 ppm, wherein the polymers become soluble in the cleaning liquid and form the cleaning material with the cleaning liquid and the plurality of solid components, and wherein the solubilized polymers having long polymer chains capture and entrap solid components and contaminants in the cleaning liquid.

* * * * *